US009968819B2

(12) United States Patent
Hockridge

(10) Patent No.: US 9,968,819 B2
(45) Date of Patent: May 15, 2018

(54) FUNCTIONAL TRAINER EXERCISE MACHINE

(71) Applicant: Hoist Fitness Systems, Inc., Poway, CA (US)

(72) Inventor: Bruce Hockridge, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 4 days.

(21) Appl. No.: 14/633,769

(22) Filed: Feb. 27, 2015

(65) Prior Publication Data

US 2015/0246258 A1 Sep. 3, 2015

Related U.S. Application Data

(60) Provisional application No. 61/946,541, filed on Feb. 28, 2014.

(51) Int. Cl.

| | |
|---|---|
| ***A63B 21/062*** | (2006.01) |
| ***A63B 1/00*** | (2006.01) |
| ***A63B 21/00*** | (2006.01) |
| ***A63B 23/035*** | (2006.01) |
| *A63B 21/005* | (2006.01) |

(Continued)

(52) U.S. Cl.

CPC ..... *A63B 21/0628* (2015.10); *A63B 1/00* (2013.01); *A63B 21/156* (2013.01); *A63B 21/4043* (2015.10); *A63B 23/03541* (2013.01); *A63B 21/005* (2013.01); *A63B 21/0083* (2013.01); *A63B 21/0087* (2013.01); *A63B 21/0552* (2013.01); *A63B 23/1218* (2013.01); *A63B 2210/50* (2013.01); *A63B 2225/093* (2013.01); *A63B 2225/102* (2013.01); *A63B 2225/685* (2013.01)

(58) Field of Classification Search

CPC ..... A63B 21/0626; A63B 21/0628

See application file for complete search history.

(56) References Cited

U.S. PATENT DOCUMENTS

| | | | |
|---|---|---|---|
| 5,102,122 | A | 4/1992 | Piane, Jr. et al. |
| 6,447,430 | B1 | 9/2002 | Webb et al. |

(Continued)

FOREIGN PATENT DOCUMENTS

| | | | |
|---|---|---|---|
| CN | 200970431 | Y | 11/2007 |
| DE | 19801672 | A1 | 11/1998 |

OTHER PUBLICATIONS

Hoist V6 Personal Pully Gym, Mar. 2007, 2 pgs.

(Continued)

*Primary Examiner* — Loan H Thanh
*Assistant Examiner* — Rae Fischer
(74) *Attorney, Agent, or Firm* — Gordon Rees Scully Mansukhani LLP; David R. Heckadon

(57) ABSTRACT

An exercise machine has at least one hollow column rotationally mounted between upper and base members of a frame. A pulley carriage is mounted inside the column in engagement with an internal track for travel up and down the track, and a cable linked to an exercise resistance extends through the pulley carriage before terminating at a cable pull attachable to a selected user engagement accessory. A pulley cover pivoted to the carriage extends partially out of a column opening and extends over one or more pulleys mounted in the pulley carriage.

32 Claims, 23 Drawing Sheets

(51) Int. Cl.

| | |
|---|---|
| *A63B 21/008* | (2006.01) |
| *A63B 21/055* | (2006.01) |
| *A63B 23/12* | (2006.01) |

(56) References Cited

U.S. PATENT DOCUMENTS

| | | | | |
|---|---|---|---|---|
| 6,491,609 | B2 | 12/2002 | Webber | |
| 6,497,639 | B2 | 12/2002 | Webber et al. | |
| 6,770,015 | B2 | 8/2004 | Simonson | |
| 7,651,443 | B1 * | 1/2010 | Fenster | A63B 23/035 482/103 |
| 7,686,749 | B2 * | 3/2010 | Keiser | A63B 21/0087 482/112 |
| 7,909,742 | B2 | 3/2011 | Ish et al. | |
| 8,057,367 | B2 | 11/2011 | Giannelli et al. | |
| 8,070,658 | B2 | 12/2011 | Giannelli et al. | |
| 8,506,459 | B2 | 8/2013 | Cassidy et al. | |
| 8,708,872 | B2 | 4/2014 | Giannelli et al. | |
| 8,992,392 | B2 | 3/2015 | Giannelli et al. | |
| 9,089,737 | B2 | 7/2015 | Giannelli et al. | |
| 9,211,434 | B2 | 12/2015 | Giannelli et al. | |
| 2007/0037674 | A1 | 2/2007 | Finn et al. | |
| 2013/0065737 | A1 | 3/2013 | Habing | |

OTHER PUBLICATIONS

Paramount Extreme XFT-300 Functional Trainer, Mar. 2011, 1 pg.
Paramount XFT-100 Functional Trainer, 2013, 1 pg.
Paramount Extreme XFT-300 Functional Trainer, 2013, 1 pg.
Paramount Functional Training XFT-300 & FT-300, 1 pg.
Paramount XFT-300 Functional Trainer Quick Cable Replacement, 6 pgs.
Paramount XFT-100 Extreme Functional Trainer, 2011, 2 pgs.
International Search Report, PCT/US2015/017919, dated May 22, 2015, 3pgs.
Written Opinion of the International Searching Authority, PCT/US2015-017919, dated May 22, 2015, 15 pgs.

* cited by examiner

FUNCTIONAL TRAINER EXERCISE MACHINE

CROSS-REFERENCE TO RELATED APPLICATIONS

This application claims priority to U.S. Patent Application Ser. No. 61/964,541, which was filed in the U.S. Patent and Trademark Office on Feb. 28, 2014.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

This invention relates generally to a multi-functional weight training or functional trainer exercise machine or apparatus which enables performance of multiple exercises in various positions.

BACKGROUND OF THE INVENTION

Some known functional trainer exercise machines include an upright frame holding one weight stack or dual weight stacks, with left and right arms extending from the frame and each having an outer end comprising a vertical track carrying a vertically adjustable pulley carriage and having indexing holes for adjusting the carriage height. Left and right handles are secured to the ends of cables extending around the pulleys in the respective pulley carriages and secured to the weight stack or stacks via a cable and pulley linkage. In these prior machines, the pulley carriage and pulleys travel along the vertical track and are secured at a selected height by indexing pins which extend through selected indexing holes for adjusting the pulley height and thus the handle position for different exercises. The carriage, pulleys, and indexing pin are all external and project outward from the track, and adjustment can be awkward for the user. The exposed pulleys are susceptible to damage when the handle is released.

SUMMARY OF THE INVENTION

In one aspect, a functional trainer or other exercise machine has a frame with at least one column rotationally mounted between upper and lower frame portions, the column being hollow along at least a major portion of its length to define an internal channel with an internal track extending along the channel, and having an opening extending along at least a major portion of the length of the channel, and a pulley carriage assembly configured for traveling along the internal track with the majority of the pulley carriage assembly located inside the column. A cable assembly comprising one or more cables is suitably linked to an exercise resistance and extends around one or more pulleys of the pulley carriage assembly and out of the assembly, with the end of the cable terminated to a cable pull which may be secured to a selected accessory such as a pull handle 45 or the like.

In one embodiment, the pulley carriage assembly comprises a carriage, one or more pulleys rotationally mounted between pulley mounting portions of the carriage, a spring loaded indexing pull pin, and one or more wheels, rollers, or other travel members configured to travel along one or more internal tracks in the column. In one embodiment, a vertical indexing plate with spaced holes is also located inside the column, and an indexing pull pin extends through a selected hole in the indexing plate to secure the carriage assembly at a desired height. In one embodiment, the assembly also includes a pulley cover pivotally mounted over the front of the pulley carriage to extend over the pulleys and act as a guard to guard the pulleys from damage when the pull end of the cable is released. The pulley cover has an opening through which the cable extends. In one aspect, the indexing pull pin is associated with the pulley cover, which has a grip area for gripping by a user and pivoting the cover slightly outward to disengage the pull pin from an aligned indexing hole so that the height of the pull end of the cable can be adjusted. In order to adjust the height of the pulley carriage, the user simply grasps the pulley cover (at the cushioned grip area) and pulls outward to disengage the spring driven indexing pull pin. Once the desired height position is reached, the pulley cover is released so that the spring driven indexing pull pin extends into an aligned hole in the indexing plate.

In one embodiment, respective first and second columns are rotationally mounted between upper and base frame members of respective side frames of the machine, with each column having at least one internal guide track in which respective pulley carriage assemblies are engaged for movement up and down the frame.

The rotating column may be either an extrusion or a welded assembly. In one embodiment, the pulley carriage uses shouldered axles for mounting the pulleys as well as the wheels (or rollers) engaging the guide track. In this way, when all the components are assembled and inserted into the rotating column, there is no need for any retaining hardware such as nuts or snap rings.

The internal mounting of both the pulley carriage and the indexing plate results in clean aesthetics and ease of adjustment. The cable, indexing holes, indexing pin and wheels (or rollers) are all hidden within the rotating column. The pulley cover is the only visible item protruding from the rotating column, and is dual purpose since it both guards the pulleys against damage when the pull end of the cable is released, and also provides the means for operating the spring loaded indexing pull pin, avoiding the need for another manual engagement device such as a knob or lever.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a functional trainer exercise machine having a frame and at least one column rotationally mounted between upper and lower or base frame members with a pulley carriage traveling on tracks inside the column and an indexing plate with holes also located inside each column to allow height adjustment of the respective pulley carriage via a spring loaded pull pin or other releasable locking device. In one embodiment, the frame has opposite side frames and respective first and second columns are rotationally mounted between upper and lower frame members of the respective side frames.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
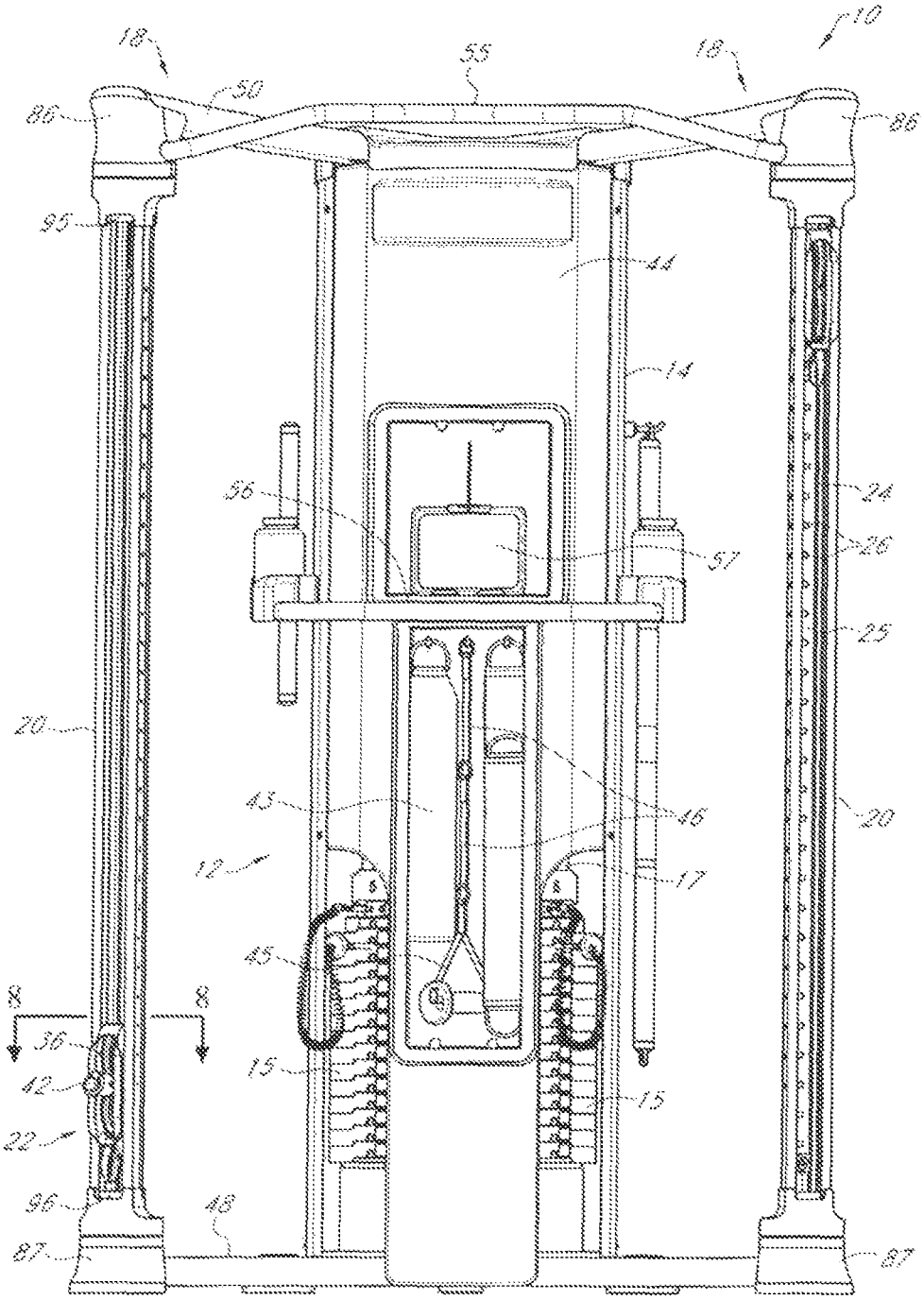
FIG. 1 is a front elevation view of one embodiment of a functional trainer exercise machine.
Figure 2:
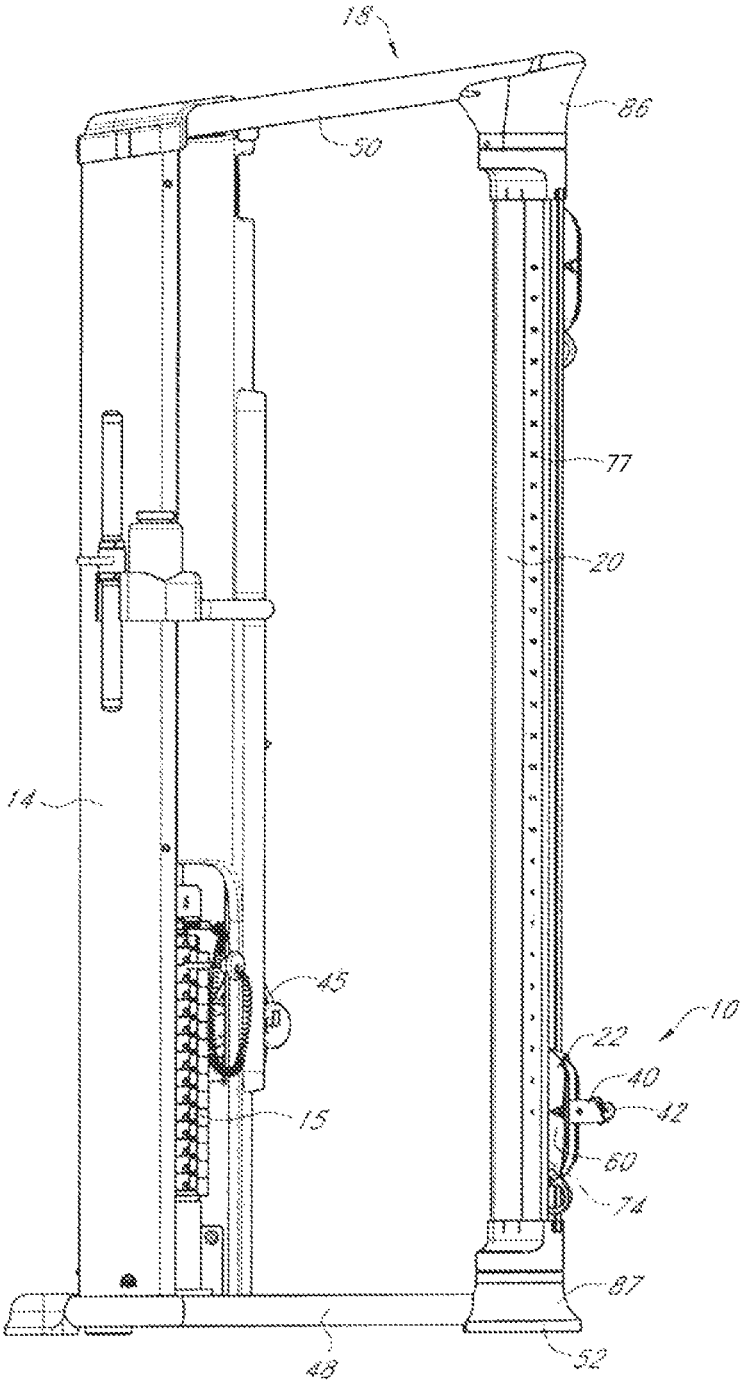
FIG. 2 is a left side elevation view of the machine of FIG. 1.
Figure 3:
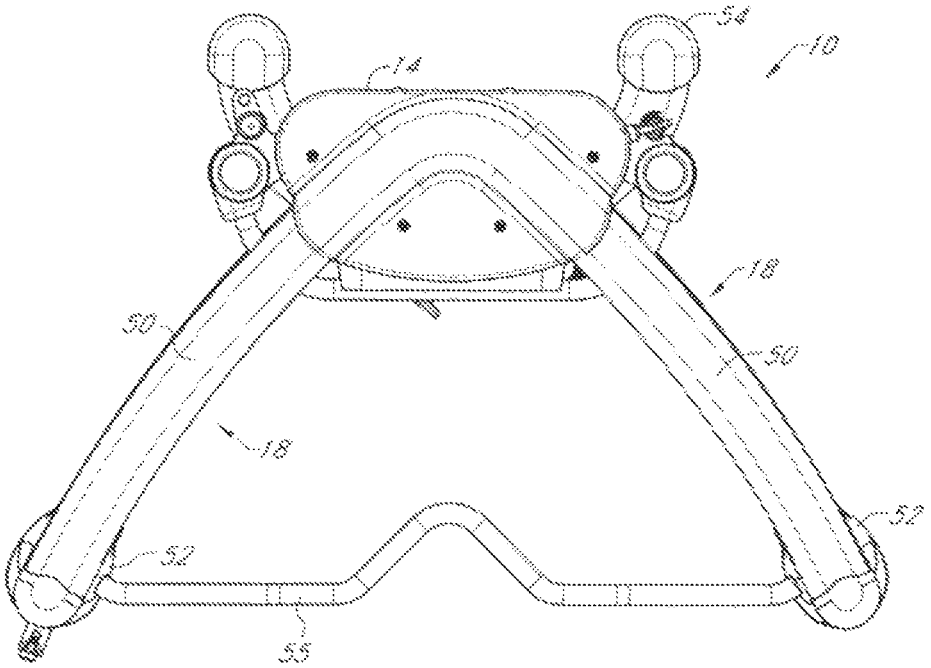
FIG. 3 is a top plan view of the machine of FIGS. 1 and 2.
Figure 4:
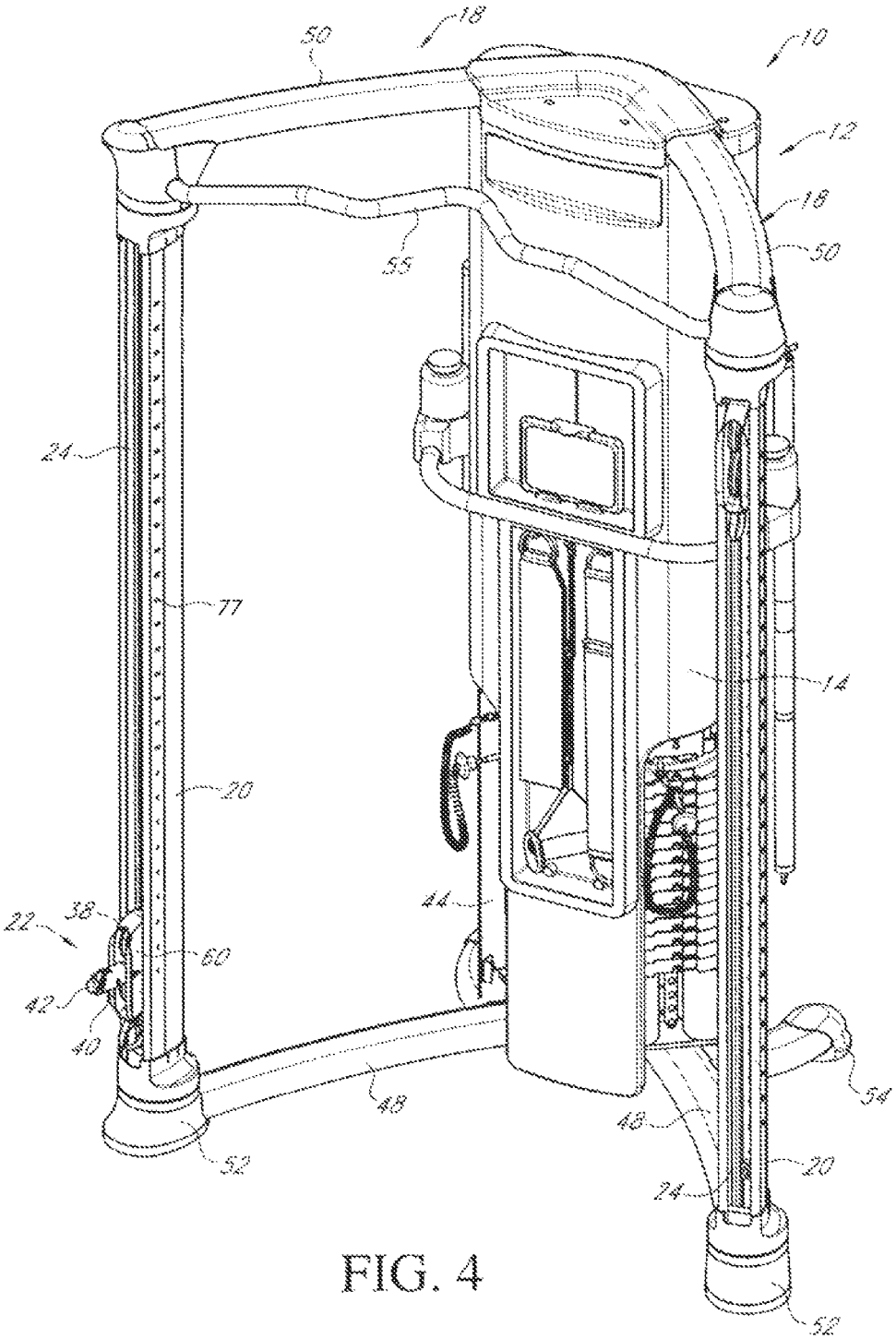
FIG. 4 is a front perspective view of the machine of FIGS. 1 to 3.

FIGS. 1 to 20 illustrate one embodiment of a functional trainer exercise machine or apparatus 10. As best illustrated in FIGS. 1 to 4, 12, 19 and 20, the machine 10 has a stationary frame 12 which comprises a rear weight stack housing, enclosure, or backbone 14 in which dual weight stacks 15 are mounted via guide rods 17, and first and second side frames 18 extending forwards and outwards from weight stack enclosure 14 to from a generally V-shape when viewed from above (see FIGS. 3 and 4). Each side frame 18 has upper and lower frame portions or members 50, 48, respectively. First and second columns 20 are rotationally mounted between forward end portions of the upper and lower members 50, 48 of the respective side frames. Each column is at least substantially hollow with an internal channel and one or more vertical guide tracks 76 inside the channel or column. First and second pulley carriage assemblies 22 are mounted in the respective channels for travel along the vertical tracks 76 inside the columns. The pulley carriage assemblies 22 project partially out of front openings 24 of the respective columns, as best seen in FIGS. 2 and 4. An indexing plate 25 with a plurality of spaced holes 26 is mounted inside each column facing opening 24 and the respective pulley carriage assembly 22, with a spacer 21 on the back of the plate between the plate and adjacent wall of the column (see FIGS. 1 and 8). As described in more detail below in connection with FIGS. 5 to 10C, a spring loaded pull pin 28 which is part of the pulley carriage assembly releasably engages in a hole at the selected vertical carriage height to lock the pulley carriage assembly at the selected height.

Figure 19:
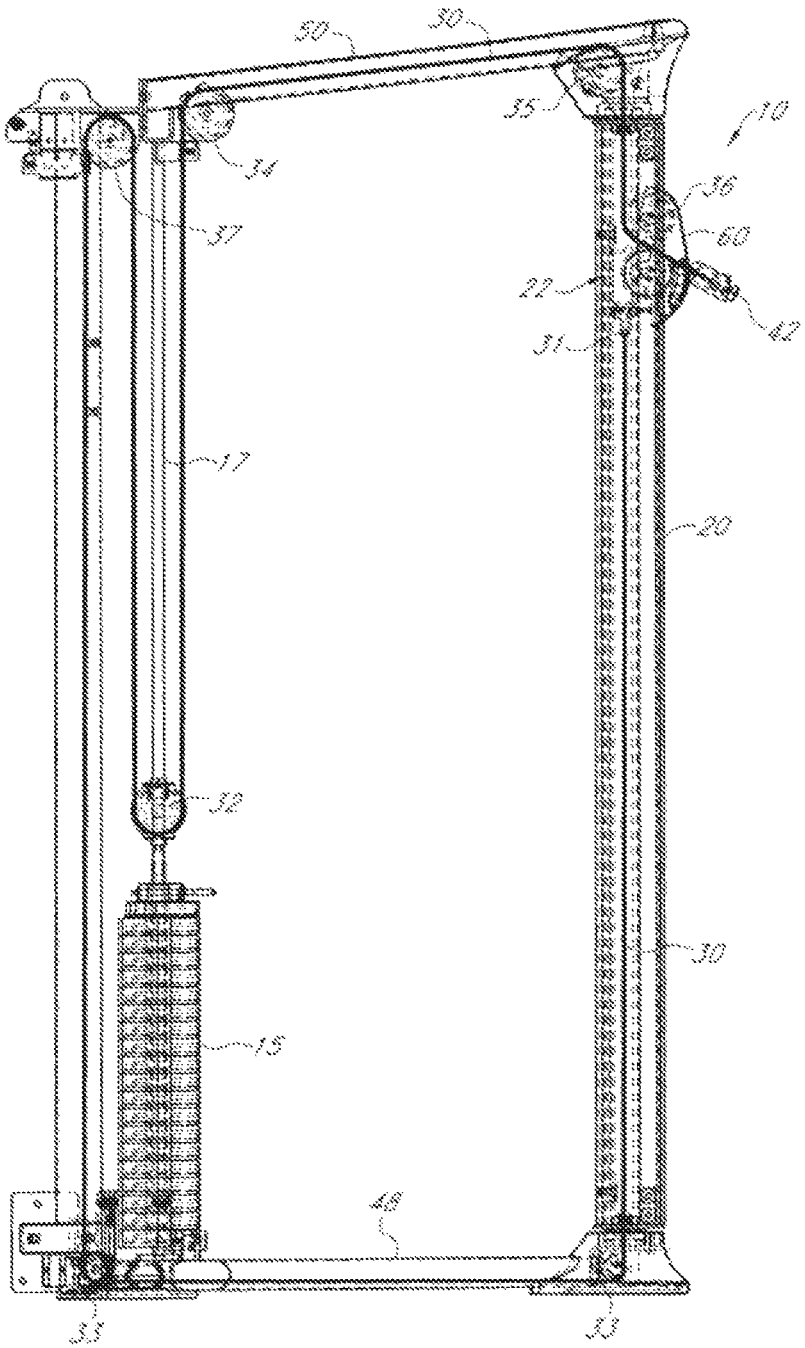
FIG. 19 is a side elevation view of the machine illustrating cable routing between the pulley carriage, weight stack and cable pull on one side of the machine.
Figure 20:
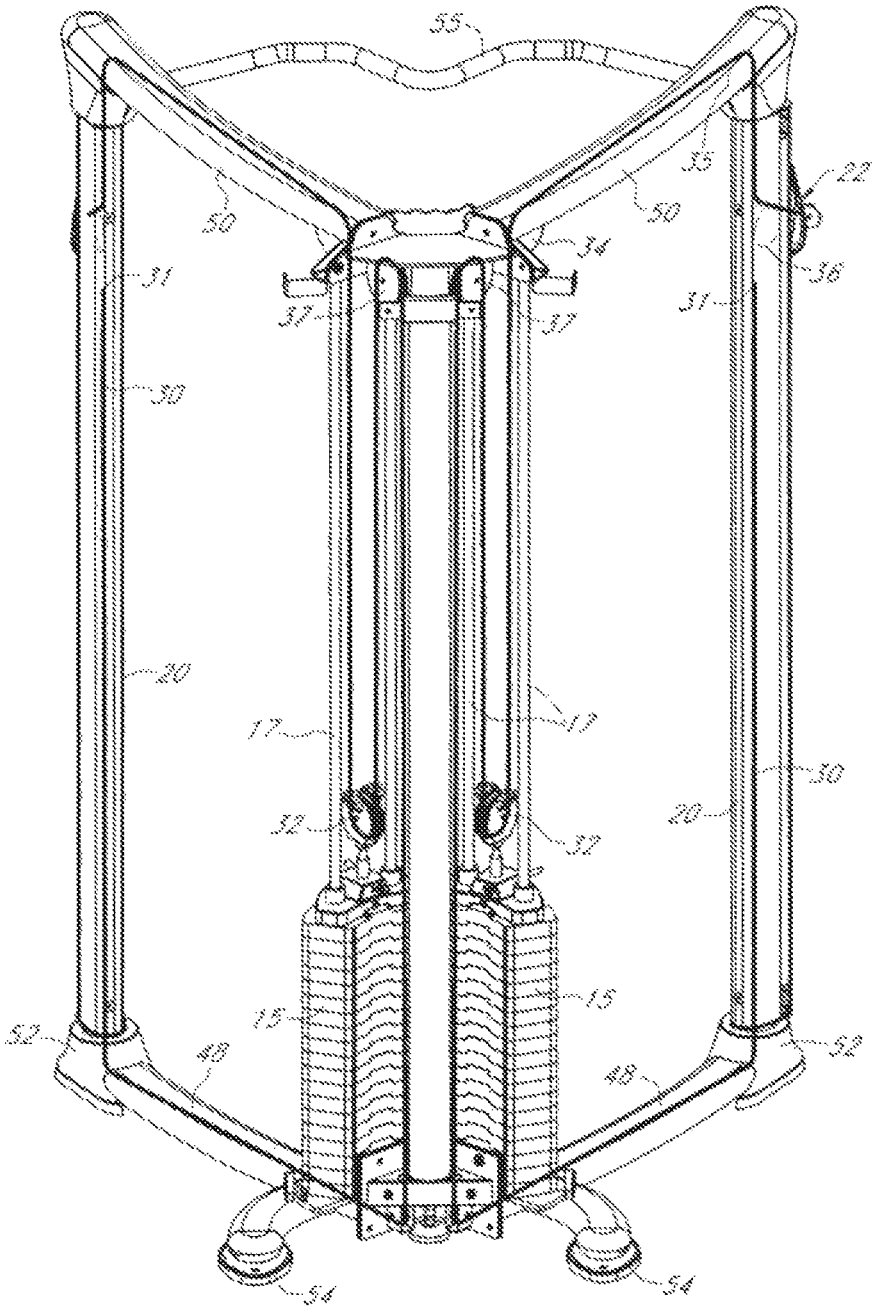
FIG. 20 is a rear perspective view of the machine illustrating cable routing between both weight stacks and the associated pulley carriage and cable pull ends.

On each side of the machine, a cable assembly which may comprise one or more cables 30 extends between a respective weight stack 15 and the respective pulley carriage assembly 22 around various pulleys in the frame, as best illustrated in FIGS. 19 and 20. Cable or cable assembly 30 has a first, fixed end 31 secured to pulley carriage assembly 22, and extends downward from assembly 22 around first and second guide pulleys 33 at the front and rear end of a lower frame member 48 of the respective side frame 18, around a pulley 37 at the top of the weight stack housing 14, and then down around pulley 32 at the top of the respective weight stack 15. After extending around pulley 32, cable 30 extends upward and forward around pulleys 34, 35 at the rear and front ends of the upper frame member 50 of the side frame 18, and down through the upper end of hollow column 20 before extending between pulleys 36 in the respective pulley carriage assembly 22 and out through the front opening 38 of the assembly. The respective cable 30 then extends through cable termination or stop 40 to pull end or cable pull 42, which can be selectively connected to any one of a plurality of different accessories which are stored on hooks in a recessed accessory storage region 43 of the front wall 44 of the weight stack housing 14, including pull handle 45 with various different length straps 46 (see FIG. 1). A shelf 56 for holding a tablet computer 57 or the like is also provided in the front wall 44 of weight stack housing 14.

Base or lower frame member 48 and top or upper frame member 50 extend from lower and upper portions of weight stack housing 14, respectively. The base frame member 48 and upper frame member 50 may optionally be parallel to each other. Base frame member 48 also includes front and rear support feet 52, 54. A chin-up bar 55 extends between the forward ends of upper frame members 50.

Figure 5:
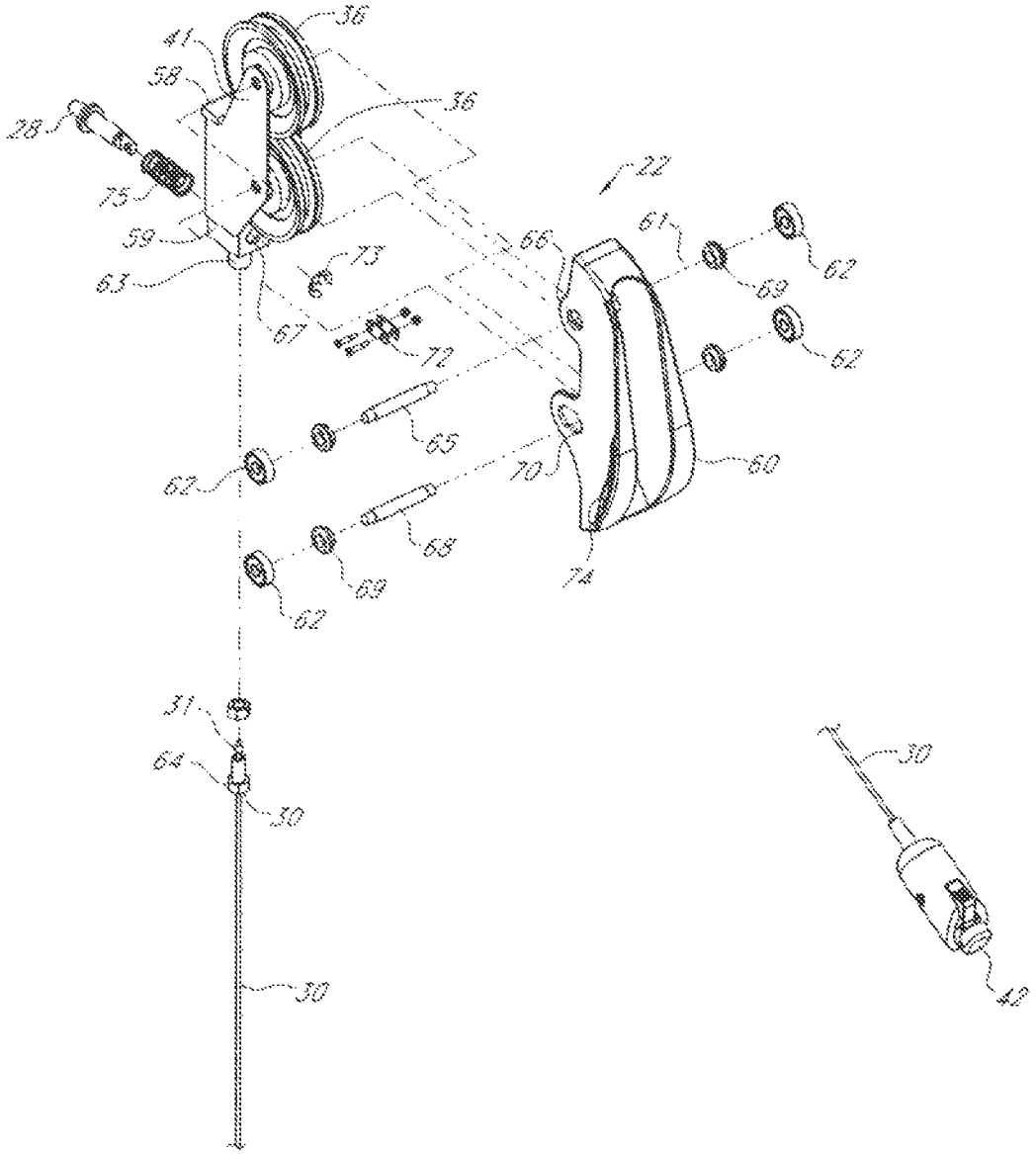
FIG. 5 is an exploded front perspective view of the components of one of the pulley carriage assemblies of FIGS. 1 to 4.

One of the pulley carriage assemblies 22 will now be described in more detail with reference to FIGS. 5 to 10C. FIG. 5 is an exploded view illustrating all components of the carriage assembly 22, positioned relative to the respective cable end 31 and opposite cable pull end 42. The pulley carriage assemblies 22 are both identical in structure. In one embodiment, pulley carriage assembly 22 basically comprises a pulley carriage 58 having a base or lower end 59 and spaced side walls 41 extending upwards from the base 59, between which a pair of pulleys 36 are rotationally mounted via axles 65 and 68, and a pulley cover 60 pivotally mounted over the front of pulley carriage 58 to extend over the pulleys 36. Cover 60 has a front opening 38 through which cable 30 extends on assembly of the parts. A spring-loaded pull pin 28 is linked to the cover 60 and extends through an opening 67 in the base of pulley carriage 58, as described in more detail below with reference to FIGS. 9A to 10C. Wheels or rollers 62 are located on opposite sides of the carriage 58. Cable end 31 of cable or cable assembly 30 is fixed or secured to cable termination 63 at the base of carriage 58 via cable anchor bolt 64 (see FIG. 5), while the other end of the cable and pulley linkage between the carriage assembly 22 and weight stack 15 extends from the weight stack 15, through the upper frame member 50, and downward into column 20, then between pulleys 36 and through the front opening 38 of cover 60 where it is secured through cable termination 40 to pull end 42. An upper shouldered pulley axle 65 extends between the upper wheels 62 through respective upper aligned openings 66 in the sides of pulley cover 60 and aligned openings in the of the pulley carriage side walls 41 and upper pulley 36, with a spacer 69 between each wheel 62 and the outer surface of cover 60. Lower pulley/wheel axle 68 extends through aligned slots 70 in pulley cover 60 which are spaced below openings 66, and aligned openings in pulley carriage side walls 41 and upper pulley 36. Shouldered axles 65, 68 are used to rotationally mount both pulleys 36 and wheels 62, so that there is no need for any retaining hardware such as nuts or snap rings when these components are inserted into the rotating column 20. Slots 70 control the pulley cover range of motion when pivoting about upper axle 65.

Figure 6:
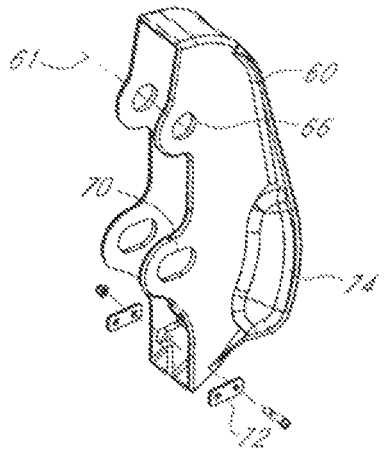
FIG. 6 is a rear perspective view of the pulley cover of FIG. 5.
Figure 7:
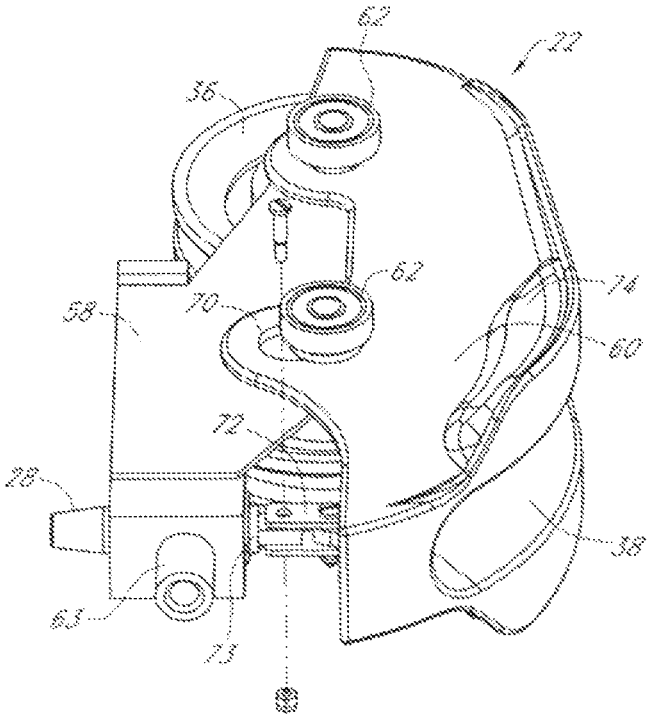
FIG. 7 is a bottom perspective view of the assembled pulley cover and carriage, illustrating the connecting link.

As illustrated in FIGS. 5, 6 and 7, pivotal connecting links 72 are each pivotally secured at one end to cover 60 and at the other end to pull pin 28. A retaining e-clip 73 is also provided around the end of pin 28 projecting from carriage 58 into the space between links 72 (see FIGS. 5 and 7). As best illustrated in FIGS. 2, 6 and 7, cover 60 extends partially out of column 20 and has an outer cushioned grip area 74 on each side of opening 38, which can be gripped and pulled by the user so as to pivot the cover outwards about axle 65 while axle 68 slides along slot 70 and the cover 60 movement retracts the pull pin 28 from an aligned hole 26 in index plate 25. This compresses spring 75 so that the pin 28 is biased into an aligned hole 26 when the user has re-positioned the carriage assembly 22 at the desired height and released the cover 60. Thus the pulley cover 60 has the dual purpose of guarding the pulleys 36 from damage when the pull end 42 of cable 30 is released and acting as the manual engagement device for operating the spring loaded pull pin 28, avoiding the need for a separate operating device on the pull pin 28, such as a knob or lever.

Figure 8:
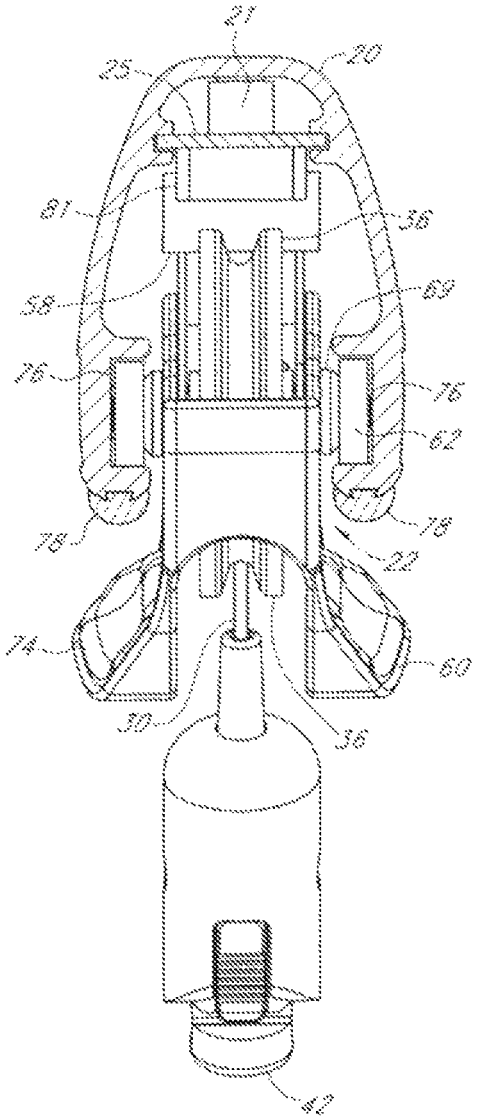
FIG. 8 is a cross-sectional view on the lines 8-8 of FIG. 1, illustrating the pulley carriage engaged in the rotating column with the wheels engaged in the internal tracks.
Figure 9C:
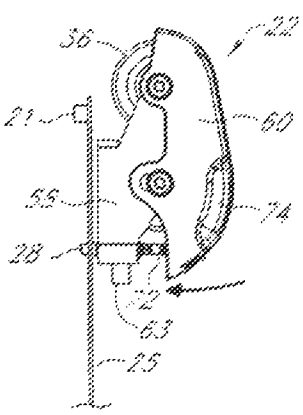
FIGS. 9A to 9C are front perspective, rear perspective, and side elevation views, respectively, of the pulley carriage assembly and indexing plate with the pull pin engaged in a hole in the indexing plate.
Figure 9B:
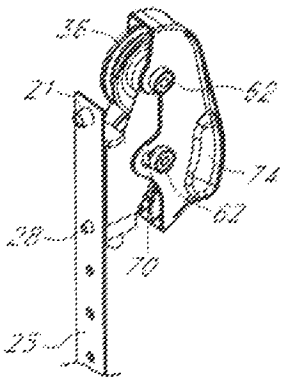
Figure 9A:
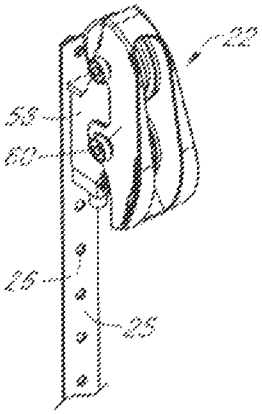
Figure 10C:
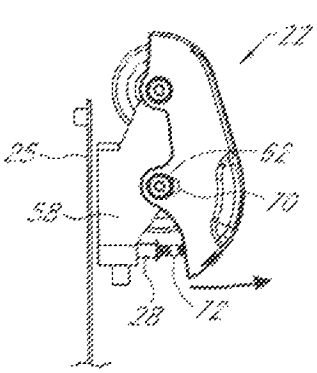
FIGS. 10A to 10C are similar views to FIGS. 9A to 9C but with the pull pin disengaged from the indexing plate.
Figure 10B:
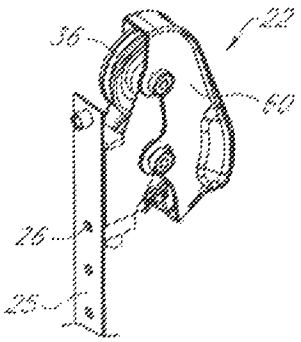
Figure 10A:
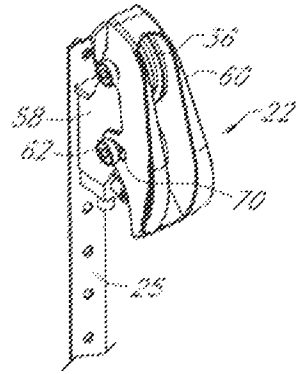

FIG. 8 illustrates pulley carriage assembly 22 installed in a respective column 20, while FIGS. 9A to 10C illustrate the position of the cover 60 and pull pin 28 in engaged and released positions relative to indexing plate 25. As illustrated in FIG. 8, wheels or rollers 62 of the carriage assembly 22 are engaged in opposing tracks or grooves 76 in the opposite inner faces of column 20. The slots 70 in cover 60 through which lower axle 68 extends allow the pulley cover 60 to pivot in and out about pivot axis 61 (see FIGS. 5 and 6) as the lower axle 68 travels between opposite ends of slots 70. FIGS. 9A to 9C illustrate the innermost, released position of the cover 60 with the pull pin 28 biased by spring 75 in the direction of the arrow in FIG. 9C into engagement with an aligned hole 26 in the indexing plate 25 hidden inside column 20. FIGS. 10A to 10C illustrate the pivoted outward position of the cover 60, where the user has pulled the lower part of cover 60 outwards at grip 74 so that it pivots about axle 65 in the direction of the arrow in FIG. 10C to release pin 28 from the indexing plate 25 to allow the pulley carriage 58 to travel up and down inside column 20 to a desired height. As illustrated in FIGS. 2 and 4, a numbered indexing scale 77 may be provided on the column 20 adjacent the column opening 38 to indicate the locations of openings 26. Once the desired height is reached, the user simply releases the cover grip 74 and the pin 28 and cover 60 are biased back into the locked position of FIGS. 9A to 9C by biasing spring 75.

Figure 11:
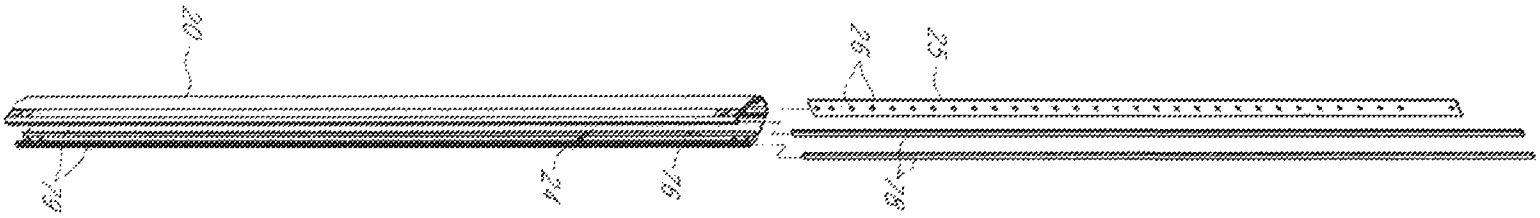
FIG. 11 is an exploded perspective view of the column, indexing plate, and front guard strips on opposite sides of the column opening.
Figure 12:
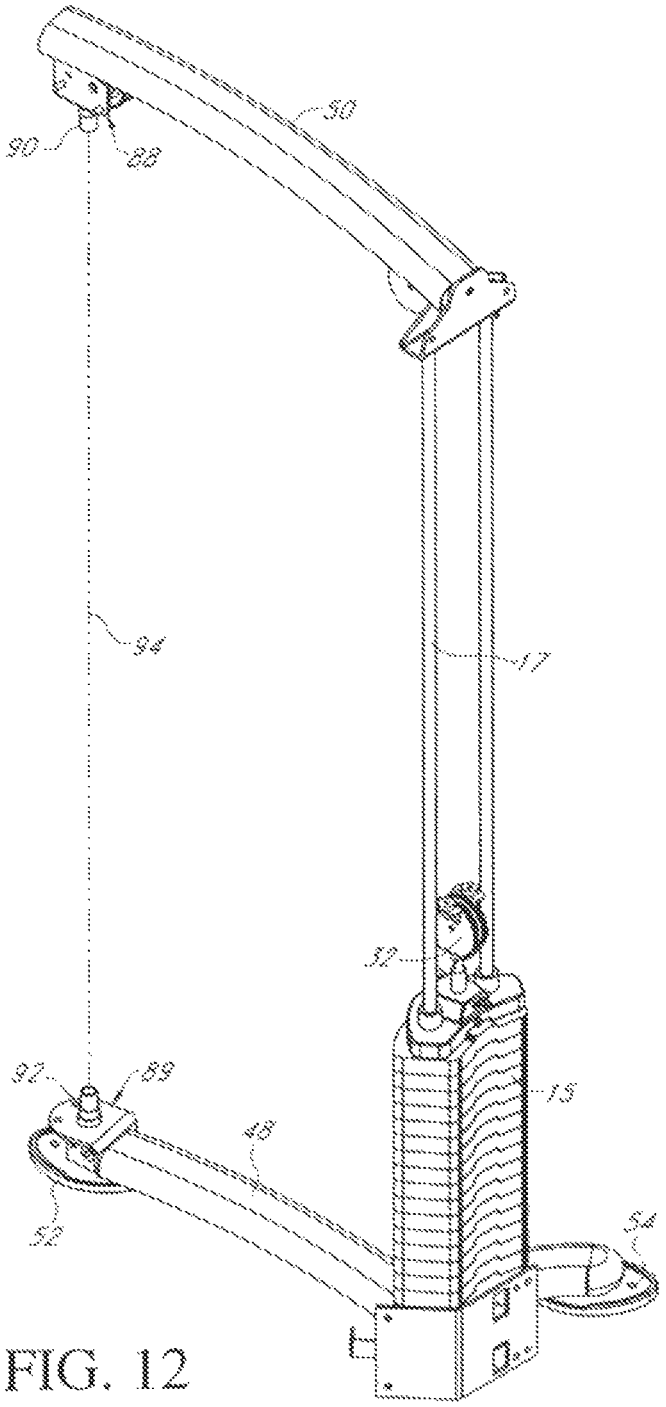
FIG. 12 is a rear perspective view of one side of the machine of FIGS. 1 to 4 with the rotatable column and pulley carriage assembly omitted to reveal the top and bottom pivot mounts.
Figure 17:
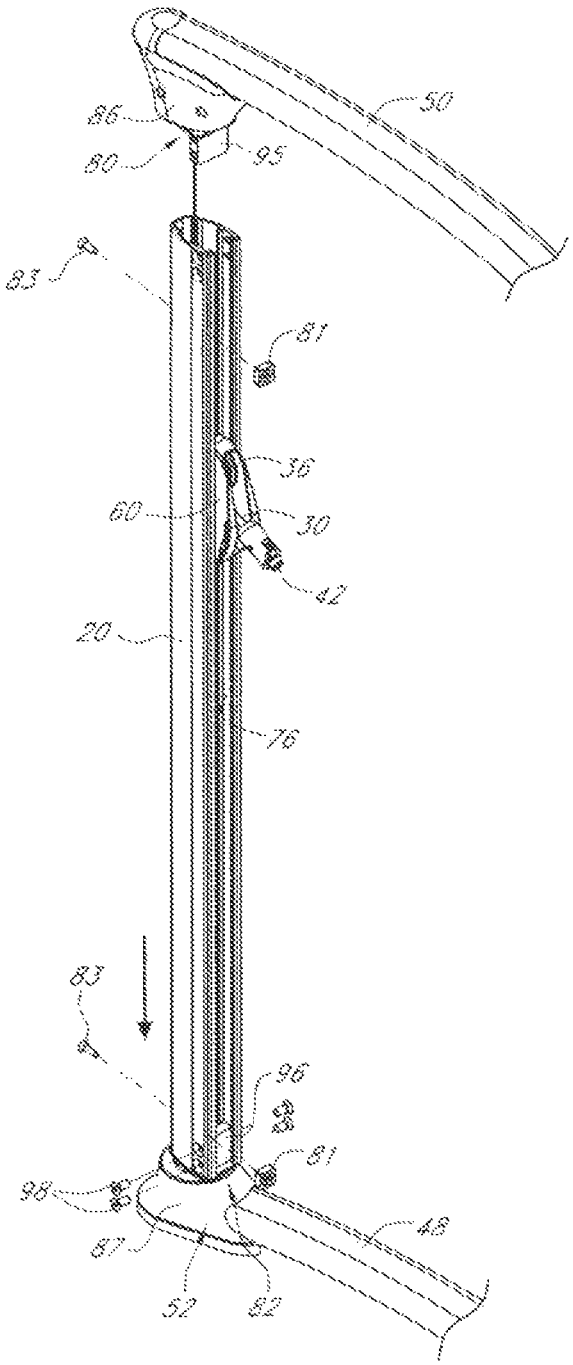
Figure 18:
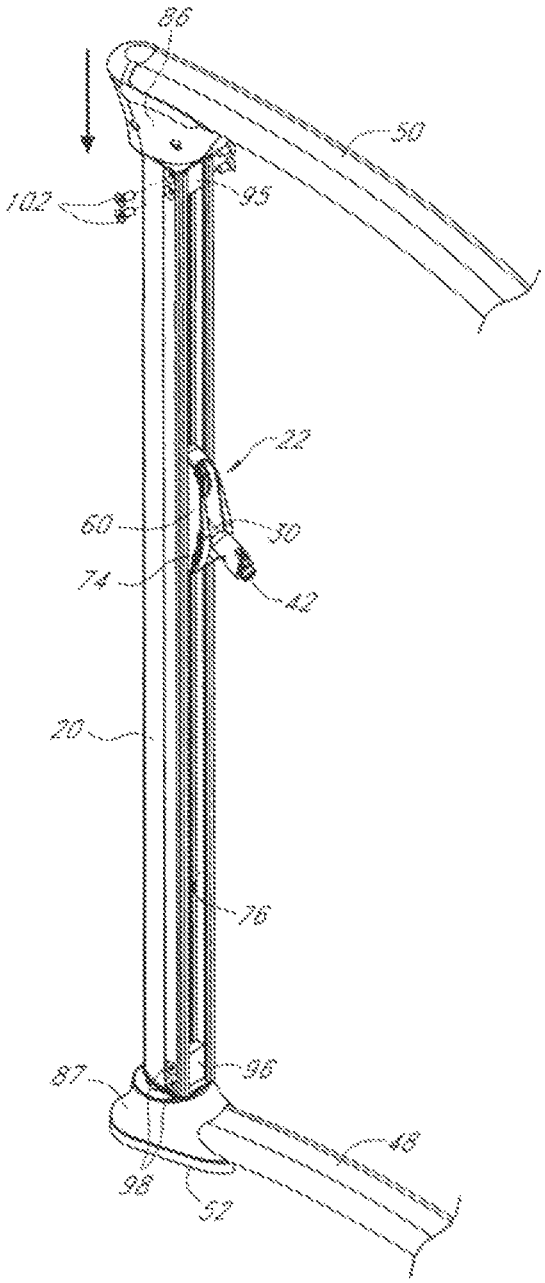

FIG. 11 is an exploded view of the rotating column 20, indexing plate 25, and a pair of guard strips 78 prior to assembly, while FIGS. 12 to 17 illustrate successive steps in assembly of the pulley carriage 58 in the column 20 and rotatable attachment of the column 20 between the forward ends of upper and lower side frame members 50, 48. Guard strips 78 (shown separate from column 20 in the exploded view of FIG. 11) are secured across the front rims 79 of the column 20 to protect the rims 79 when the cover plate 60 is released from a biased outward position, as seen in FIG. 8. Indexing plate 25 is secured in place inside the column 20 facing the carriage assembly 22 via flathead bolts 83 and bumpers 81 at its upper and lower ends, as best seen in FIGS. 8 and 17. FIG. 12 illustrates one side of the functional trainer machine 10 with the rotating column 20 as well as the opposing top and bottom outer covers 86, 87 (see FIG. 14) at the forward ends of the upper and base frame members 50, 48 removed, to reveal upper and lower pivot mounts 88, 89 for column 20. Pivot mounts 88 and 89 include a top pivot spindle 90 and bottom pivot spindle 92, respectively, for rotationally mounting column 20 between the upper and base frame members to rotate about pivot axis 94. When the columns 20 are rotationally mounted between the upper and base/lower frame members 50, 48, the covers 86, 87 cover and protect the rotationally engaged parts of the pivot connections and also conceal the cables 30. This arrangement allows each column 20 to rotate freely through 360 degrees.

Figure 13:
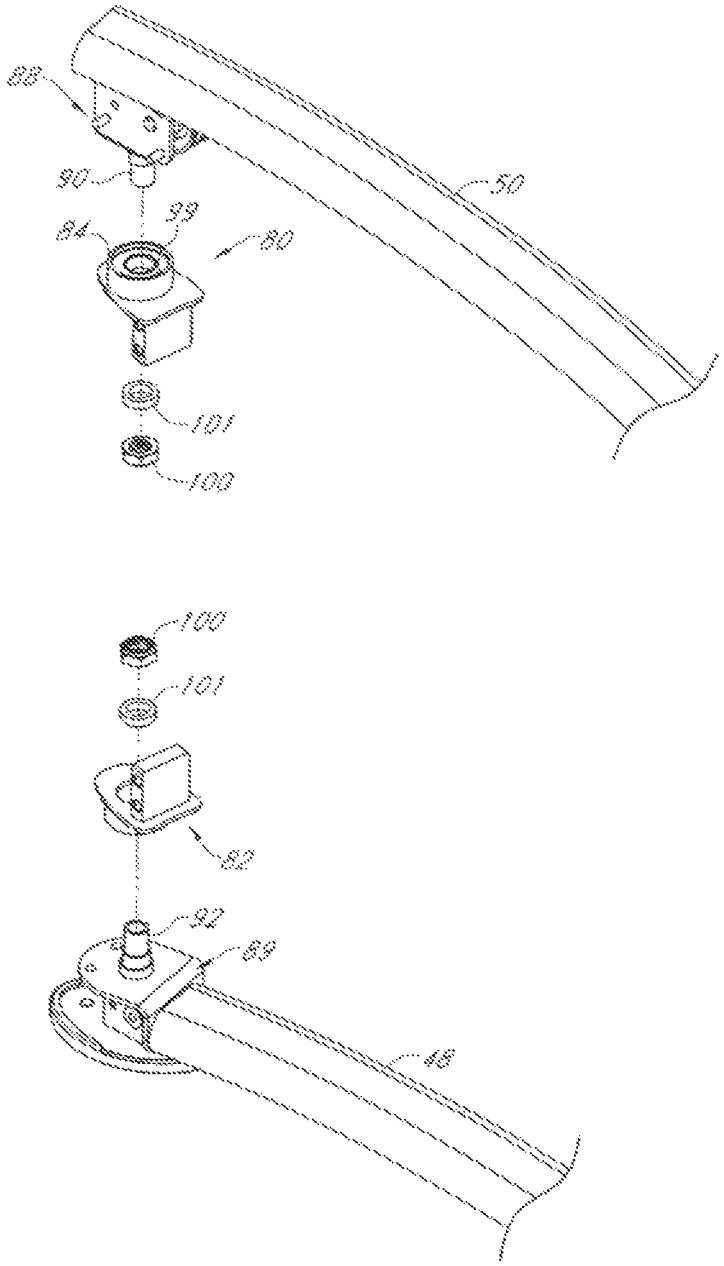
FIG. 13 is a front perspective view of part of the top and base frames of FIG. 11 and exploded components of the top and bottom column mounts prior to rotational attachment to the top and bottom pivot mounts of FIG. 12.
Figure 14A:
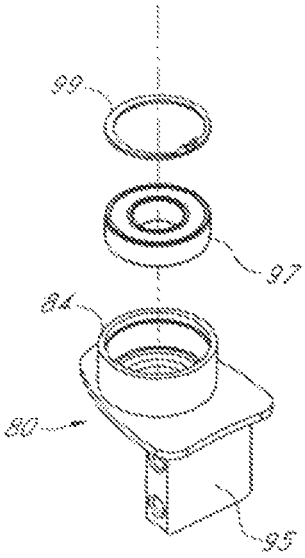
FIG. 14A is an exploded view of the upper column mount of FIG. 13.
Figure 14B:
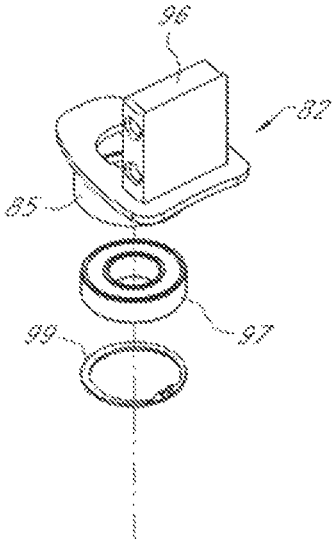
FIG. 14B is an exploded view of the lower column mount of FIG. 13.

FIG. 13 illustrates the pivot mounting arrangement between the top and bottom of the column 20 and pivot spindles 90, 92 in more detail. As illustrated in FIG. 13, top and bottom column mounts 80, 82 have pivot sleeves 84, 85 projecting from one face and channel inserts 95, 96, respectively projecting from the opposite face. Each pivot sleeve contains a bearing 97 and retaining ring 99 for rotatable engagement with the top and bottom spindle 90, 92, respectively. Each spindle 90, 92 extends through the respective pivot sleeve 84, 85 and an aligned opening in the respective pivot mount 88, 89 and is secured in rotatable engagement with the pivot sleeve 84, 85 via nut 100 and spacer 101, as indicated in FIG. 13.

Figure 15:
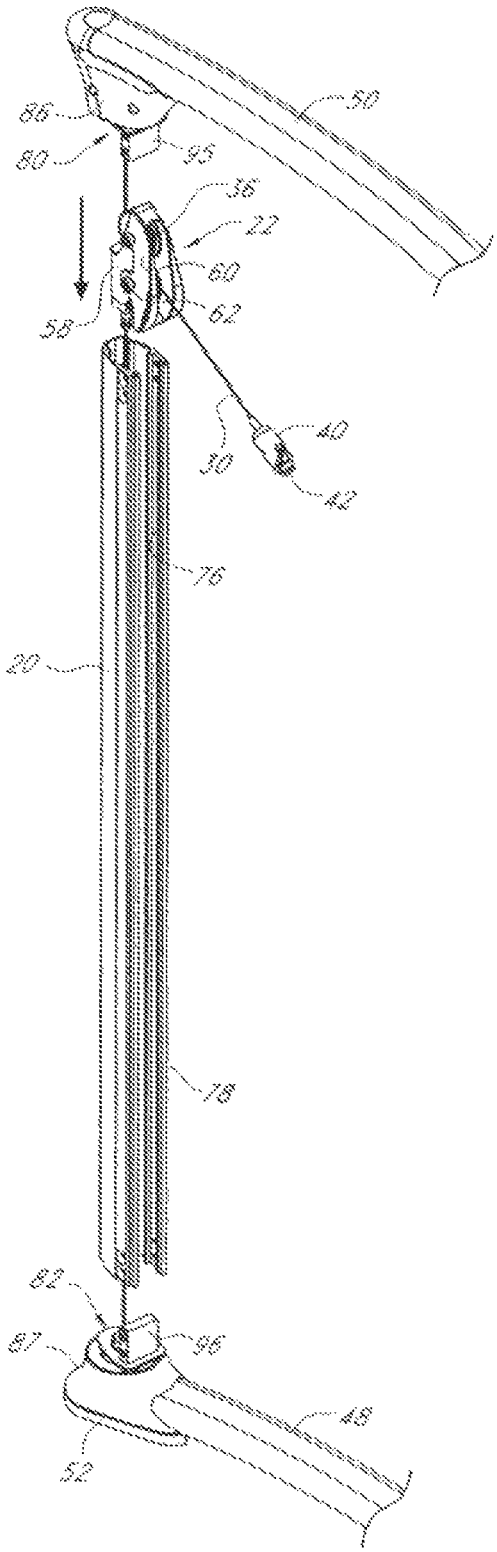
FIGS. 15 to 18 are perspective view of successive stages of assembly of the rotating column and pulley carriage assembly at the forward ends of the top and base frame on one side of the machine.
Figure 16:
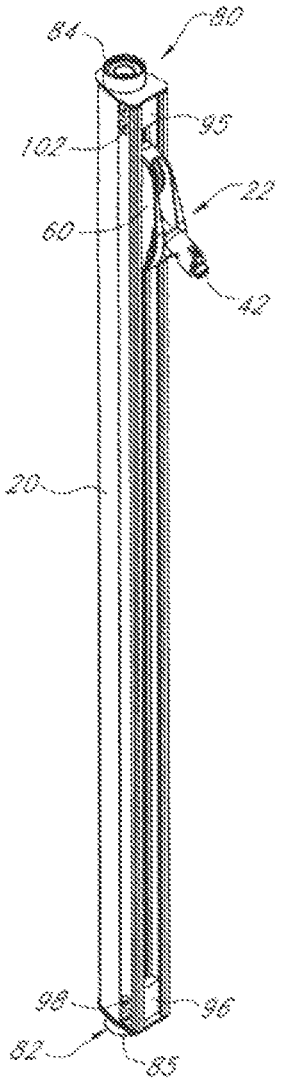

The top and bottom column mounts 80 and 82 are each rotationally secured to the respective spindles 90, 92, as seen in the exploded view of FIG. 13 and in the assembled view of FIG. 15. Prior to attachment of the bottom column mount 82, one end 31 of the cable 30 is threaded through the through bore in bottom mount 82 and secured to the cable anchor 63 at the lower end of pulley carriage 58 via cable anchor bolt 64. The opposite end of the cable or cable assembly 30 is pulled from the forward end of top frame member 50, threaded through top column mount 80 and between pulleys 36 and out of the forward opening 38 in pulley cover 60, and is then secured to cable termination 40 and cable pull 42, as illustrated in FIG. 15. The wheels 62 of carriage assembly 22 are aligned with the tracks or channel profiles 76 in column 20, and the assembly 22 is then moved into the upper end of column 20 with wheels 62 in rolling engagement in tracks or channel profiles 76, as indicated by the arrow in FIG. 15. FIG. 8 also shows the wheels 62 in rolling engagement in channel profiles or tracks 76. As illustrated in FIG. 17, the channel insert 96 of the lower or bottom column mount 82 is aligned with tracks 76 at the lower end of the column 20, and column 20 is lowered to insert the channel insert 96 into the lower end of the column 20. The lower end of the column 20 is then attached to insert 96 via bolts 98. The top channel insert 95 is then inserted into the upper ends of tracks 76 and the upper end of column 20 is secured to insert 95 via bolts 102 (see FIGS. 16 and 18), rotationally securing the column 20 to extend vertically between the upper and lower side frame members 50, 48 with the pulley carriage assembly 22 in rolling engagement with the tracks 76 inside the column 20.

Figure 21:
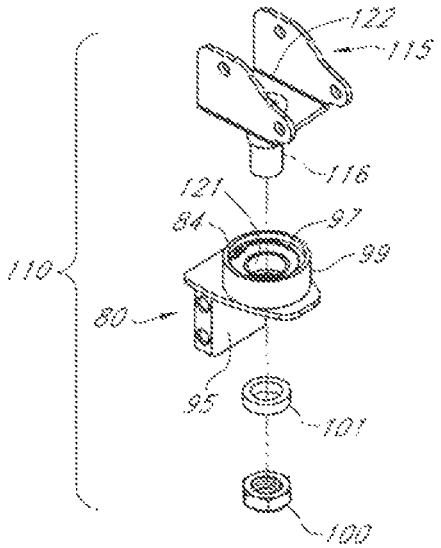
FIG. 21 is an exploded view of modified pivotal connectors for rotationally securing opposite ends of each column to the upper and lower frame members.
Figure 21:
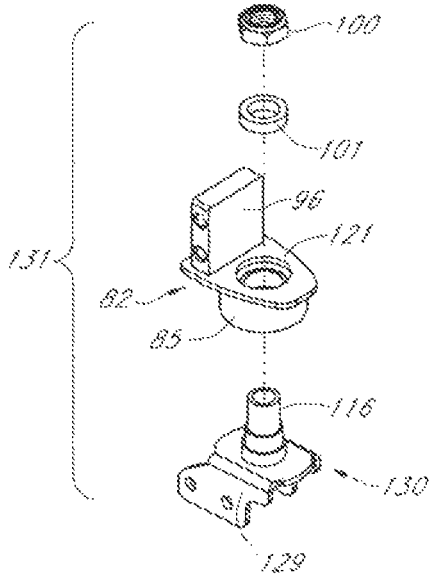
Figure 22:
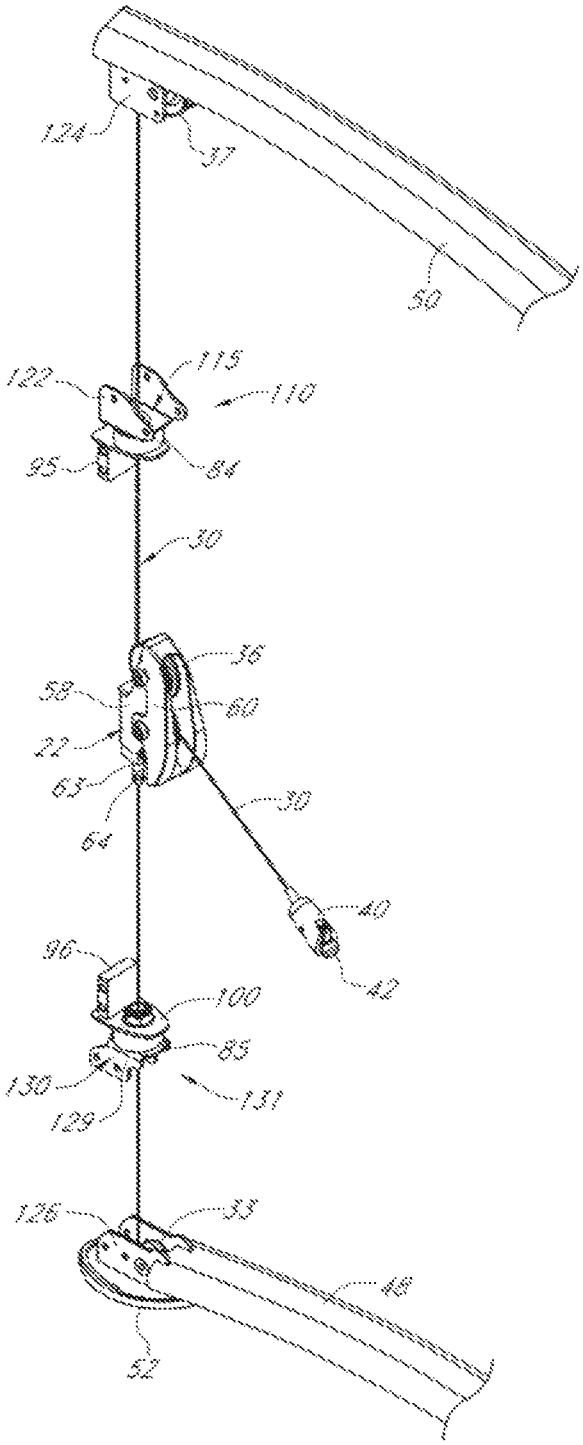
FIGS. 22 to 24 illustrate successive steps of rotationally attaching a column between the upper and lower frame members using the modified column pivot connectors of FIG. 21.

In the above embodiment, spindles 90, 92 are part of the top and base frames 50, 48 and the column mounts 80, 82 are rotationally secured to the spindles 90, 92 prior to attachment to the top and bottom ends of the columns 20 on each side of the machine 10. FIG. 21 illustrates modified upper and lower column end mounts 110, 131 according to another embodiment which may be used for rotationally securing column 20 between the top and base frame members 50, 48, as illustrated in the successive assembly steps of FIGS. 22 to 24. Apart from the modified attachment between the column 20 and upper and lower frame members 50, 48, other parts of the exercise machine 10 are identical to corresponding parts of the previous embodiment, and like reference numbers have been used for like parts as appropriate.

FIG. 21 is an exploded view of modified pivotal connectors or end mounts 110, 131 for rotationally securing opposite ends of each column 20 to the upper and lower frame members 50, 48, respectively. As illustrated in FIG. 21, each column end mount 110, 131 basically comprises first and second relatively rotatable parts. The first parts 80, 82 of the end mounts are identical to the end parts or column mounts 80, 82 of FIGS. 14A and 14B, and like reference numbers are used for like parts as appropriate. However, rather than engaging with a spindle 90, 92 which is part of the upper or lower frame member 50, 48, the top and bottom end mount 110, 131 in this embodiment have relatively rotatable first and second parts. The first parts 80, 82 attach to a respective end of the column via respective channel inserts 95 and 96, as in the previous embodiment. Each second part 115, 130 has a spindle 116 extending from an inner face which is rotationally attached to respective first part 80, 82. Ball bearing 97 and internal retaining ring 99 are installed in pivot sleeves 84, 85, respectively, which project from the opposite face of parts 80, 82 to channel inserts 95, 96, and a through bore or hole 121 extends through each part 80, 82 in alignment with the column pivot axis 94. As illustrated in FIG. 21, the second part 115 of top or upper end mount 110 comprises a bracket 122 for attachment to the top frame member 50, with spindle 116 projecting from bracket 122. The second part 130 of lower end mount 131 comprises a bracket 129 for attachment to the bottom or base frame member 48, with spindle 116 projecting from bracket 129. Each spindle 116 extends through the bearing 97 and through the bore 121, and is rotationally secured to the first part 80, 82 of the respective column mount via spacer 101 and nut 99.

Figure 23:
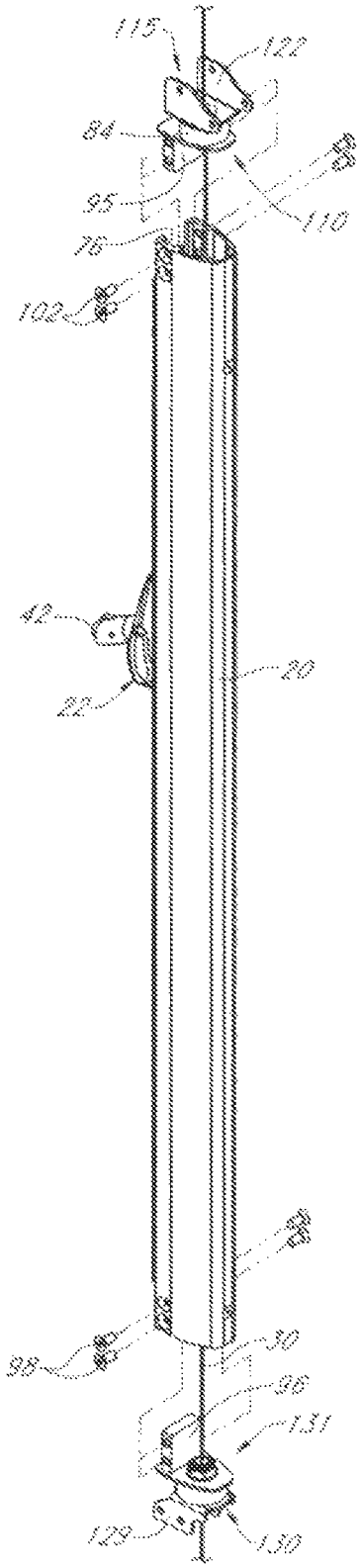
Figure 24:
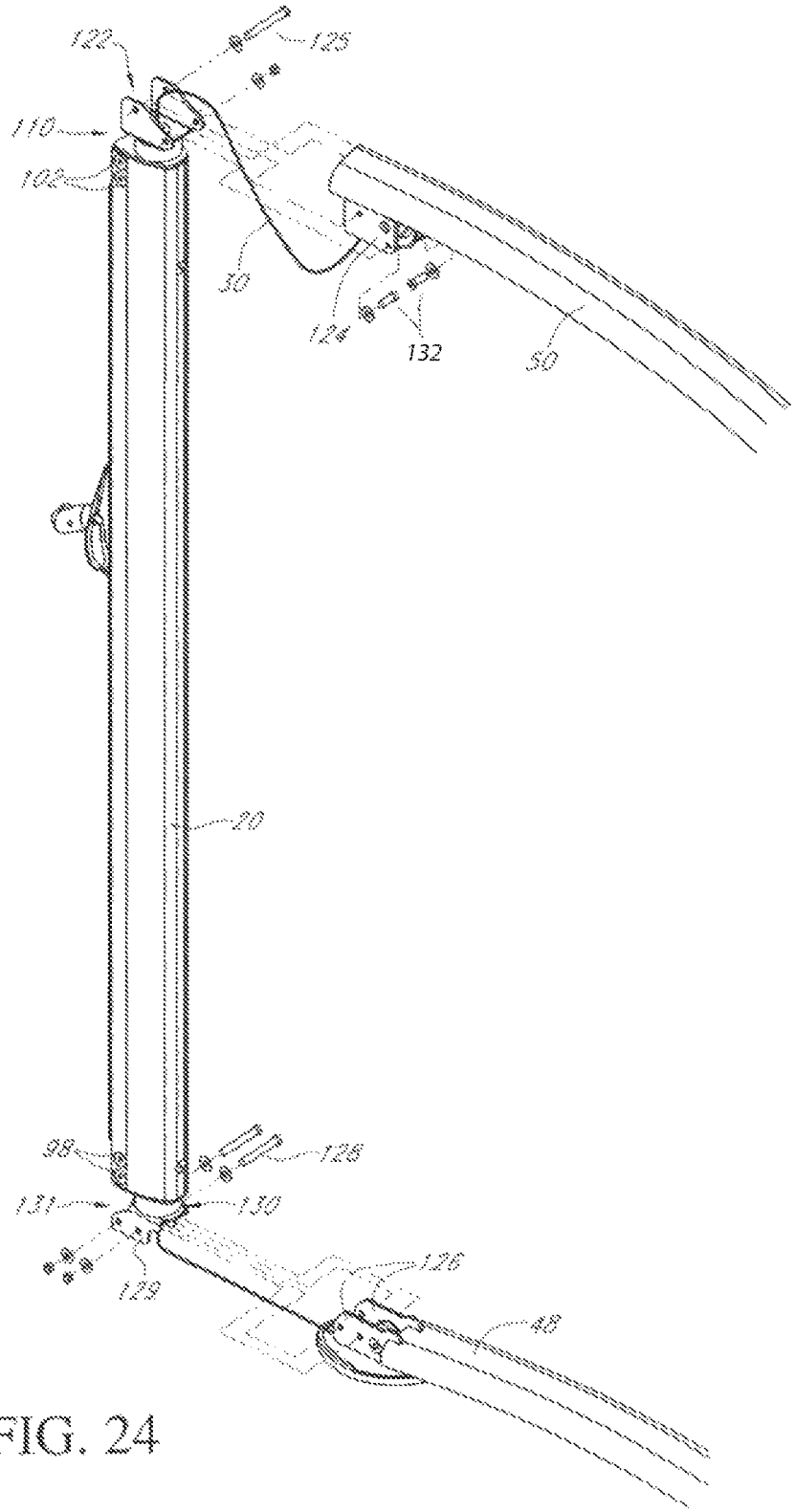

In one embodiment, in order to mount columns 20 to the respective side frames 18 using the modified top and bottom end mounts 110, 131, each cable or cable assembly 30 is first routed through the framework and components between the respective weight stack 15 and pulley carriage assembly 22. One cable end is extended upward from lower pulley 33 through the bottom assembled column end mount 131 and secured via cable tie 64 to cable anchor 63 of the pulley carriage 58. The other cable end is extended downward from upper pulley 37 through the top cable mount 110, and through carriage assembly 22 between pulleys 36 and out of cover opening 38, before connecting to cable pull 42 (see FIG. 22). The pulley carriage 58 is then positioned towards the top frame 50, column 20 is arranged around the cable 30 to align the tracks 76 with wheels or rollers 62, and the carriage 58 is engaged in the column 20 (FIG. 23). The top and bottom column mounts or spindle/bearing mounts 110, 131 are then aligned with the tracks or channel profiles 76 at the top and bottom of the column 20, then slid into place with channel inserts 95, 96 engaged in the column ends and attached to the column via flathead bolts 102, 98, respectively, as indicated in FIGS. 23 and 24. As illustrated in FIG. 24, the upper rotating part 115 of the top column mount 110 is then slid horizontally into alignment with mounting bracket 124 of the top frame member 50, and attached to bracket 124 using screw fasteners or bolts 125, 132. Similarly, the lower rotating part 130 of the bottom column mount 131 is slid horizontally into alignment with brackets 126 at the end of the base frame member 48, and secured to the bracket 126 via screw fasteners or bolts 128. The column end mounts with relatively rotatable parts make it easier to mount column 20 by sliding it horizontally into position between the top and base frame 50, 48, as compared with the vertical assembly method of the previous embodiment.

In the foregoing embodiments, the cable 30, indexing plate 25 with holes 26, indexing pin 28, and wheels or rollers 62 of the pulley carriage 58, as well as most of the pulley carriage assembly 22 itself, are all hidden within the rotating column 20. The only visible item protruding from the column 20 is part of the pulley cover 60, which has the dual function of guarding the pulleys 36 from damage when the pull end 42 of the cable 30 is released by a user, and also acting as a grip 74 for a user to release the pull pin 28 from an indexing hole 26 and allowing the carriage assembly 22 to be raised or lowered to a desired height, at which point the cover 60 is released to allow the pin 28 to engage in an aligned, completely hidden hole 26 in the indexing plate 25. This arrangement provides clean aesthetics as well as ease of cable pull 42 height adjustment.

Although the exercise resistance in the above embodiments comprises dual weight stacks 15 each linked to a respective pulley carriage assembly 22, the resistance may alternatively be a single weight stack 15 to which each pulley carriage 58 is linked in alternative embodiments. Any other type of resistance known in the art may alternatively be used, such as weight plates, hydraulic, pneumatic, electromagnetic, or elastic bands, in place of the weight stack 15. Although there are two rotating columns 20 each containing a movable pulley carriage assembly 22 with respective cable pulls 42 extending out of the column 20 in the above embodiments, the apparatus 10 may have a single rotating column 20 or three or more such columns 20 in alternative embodiments. Additionally, although the carriage 58 is described as having wheels or rollers 62 which engage in the opposing tracks or grooves 76, any other type of device configured for travel along the tracks or grooves 76 may be used in place of wheels or rollers 62, such as sliders, roller bearings, or the like. The two opposing grooves 76 in which wheels or rollers 62 are engaged in the foregoing embodiments may be replaced by a single groove or track 76 engaged by a single roller 62, roller bearing or slider on the carriage 58 in alternative embodiments.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

LIST OF REFERENCE NUMERALS]

| | |
|---|---|
| 10 | functional trainer exercise machine |
| 12 | stationary frame |
| 14 | weight stack housing |
| 15 | weight stack |
| 17 | guide rod |
| 18 | side frame |
| 20 | column |
| 21 | spacer |
| 22 | pulley carriage assembly |
| 24 | opening |
| 25 | indexing plate |
| 26 | spaced openings |
| 28 | pull pin |
| 30 | cable |
| 31 | cable end |
| 32 | pulley |
| 33 | guide pulley |
| 34 | pulley |
| 35 | pulley |
| 36 | pulley |
| 37 | pulley |
| 38 | front opening |
| 40 | cable termination |
| 41 | side wall |
| 42 | cable pull |
| 43 | accessory storage region |
| 44 | front wall |
| 45 | pull handle |
| 46 | straps |
| 48 | lower/base frame member |
| 50 | upper frame member |
| 52 | front support foot |
| 54 | rear support foot |
| 55 | chin-up bar |
| 56 | shelf |
| 57 | tablet computer |
| 58 | pulley carriage |
| 59 | carriage base |
| 60 | pulley cover |
| 61 | pivot axis |
| 62 | wheel/roller |

-continued

LIST OF REFERENCE NUMERALS]

| | |
|---|---|
| 63 | cable termination |
| 64 | cable anchor bolt |
| 65 | upper pulley/wheel axle |
| 66 | upper aligned opening |
| 67 | opening |
| 68 | lower pulley/wheel axle |
| 69 | spacer |
| 70 | lower aligned slots |
| 72 | connecting link |
| 73 | e-clip |
| 74 | grip |
| 75 | spring |
| 76 | guide track |
| 77 | indexing scale |
| 78 | guard strip |
| 79 | front rim |
| 80 | top column mount |
| 81 | bumpers |
| 82 | bottom column mount |
| 83 | bolts |
| 84 | pivot sleeve |
| 85 | pivot sleeve |
| 86 | top outer cover |
| 87 | bottom outer cover |
| 88 | upper pivot mount |
| 89 | lower pivot mount |
| 90 | top pivot spindle |
| 92 | bottom pivot spindle |
| 94 | pivot axis |
| 95 | top channel insert |
| 96 | bottom channel insert |
| 97 | bearing |
| 98 | bolt |
| 99 | retaining ring |
| 100 | nut |
| 101 | spacer |
| 102 | bolt |
| 110 | modified upper column end mount |
| 115 | upper second part |
| 116 | spindle |
| 121 | bore/hole |
| 122 | bracket |
| 124 | upper mounting bracket |
| 125 | fasteners/bolts |
| 126 | lower mounting bracket |
| 128 | fasteners/bolts |
| 129 | bracket |
| 130 | lower second part |
| 131 | modified lower column end mount |
| 132 | fasteners/bolts |

The list of reference numerals is provided for convenience and is intended to aid understanding of the illustrated embodiments described above. The embodiments of the present invention may be described in many different forms and should not be construed as limited to the illustrated embodiments. Likewise, the list above setting forth the reference numerals and associated components comprising the illustrated embodiments do not limit the scope of the invention as recited in the claims that follow.

I claim:

1. An exercise apparatus, comprising:

a stationary frame including an upper frame portion and a lower frame portion;

a rotatable column which has a longitudinal axis and is hollow along a part of its length to define an internal channel, the rotatable column being mounted between the upper and lower frame portions for rotation about the longitudinal axis of the column;

an internal guide track formed into and extending along the internal channel inside the rotatable column;

a pulley carriage assembly positioned within the internal guide track for vertical movement along the internal guide track, the pulley carriage assembly comprising a carriage and a pulley rotationally mounted on the carriage;

an exercise resistance;

a cable assembly coupled with the exercise resistance and including a cable within the rotatable column, the cable extending around part of the pulley and having a cable end extending out of the rotatable column; and a cable pull secured to the cable end extending out of the column, the cable pull being attachable to a selected accessory for engagement by a user when performing an exercise.

2. The exercise apparatus of claim 1 further comprising an opening in the rotatable column that extends along a portion of the length of the internal channel, wherein the cable extends out of the rotatable column by passing through the opening.

3. The exercise apparatus of claim 2, wherein a portion of the pulley carriage assembly extends out of the rotatable column through the opening in the rotatable column.

4. The exercise apparatus of claim 2, wherein the pulley carriage assembly further comprises a pulley cover which covers a portion of the pulley.

5. The exercise apparatus of claim 4, wherein a portion of the pulley cover extends out of the rotatable column through the opening in the rotatable column.

6. The exercise apparatus of claim 4, wherein the pulley cover includes an opening through which the cable extends.

7. The exercise apparatus of claim 4, wherein the pulley carriage includes a pair of pulley carriage sidewalls and the pulley is rotationally mounted between the pulley carriage sidewalls for rotation about a pivot axis.

8. The exercise apparatus of claim 7, wherein a second pulley is rotationally mounted between the pulley carriage sidewalls.

9. The exercise apparatus of claim 7, wherein the pulley carriage sidewalls have aligned openings, wherein the pulley is mounted on a pulley axle which has opposite ends extending outward through the openings in the pulley carriage sidewalls, and wherein a roller is mounted on the pulley axle and engages the internal guide track for vertical movement along the internal guide track.

10. The exercise apparatus of claim 9, wherein the internal guide track comprises a pair of grooves on opposite sides of the opening in the rotatable column, and wherein two rollers are mounted on the pulley axle, each engaging one of the grooves of the internal guide track.

11. The exercise apparatus of claim 9, further comprising:

a locking device linked to the pulley cover for releasably locking the pulley carriage assembly at a selected height, wherein the pulley cover includes spaced pulley cover sidewalls, each engaging over the respective pulley carriage sidewalls, wherein each pulley cover sidewall includes a pivot portion pivotally mounted on the pulley axle to provide rotational movement of the pulley cover between first and second positions, and wherein movement of the pulley cover between the first and second positions moves the locking device between a locked position and a released position.

12. The exercise apparatus of claim 1, wherein a portion of the pulley carriage assembly is located inside the rotatable column.

13. The exercise apparatus of claim 1, wherein at least portions of the carriage and the pulley are located inside the rotatable column.

14. The exercise apparatus of claim 1, further comprising:

an indexing plate mounted inside the rotatable column and extending vertically along the longitudinal axis of the rotatable column, the indexing plate having a plurality of spaced holes; and a locking device associated with the pulley carriage assembly which is selectably engageable with one of the spaced holes in the indexing plate to secure the pulley carriage assembly at a selected height.

15. The exercise apparatus of claim 14, further comprising a lock release mechanism associated with the locking device, wherein the lock release mechanism includes a user engagement portion outside the column which is operable by the user to disengage the locking device from the spaced holes in the indexing plate.

16. The exercise apparatus of claim 1, wherein the cable extends from the pulley upward through the rotatable column and through the upper frame portion to the exercise resistance.

17. The exercise apparatus of claim 16, wherein the cable assembly includes a second cable secured at one end to a lower end of the carriage and extending downward through the rotatable column and the through lower frame portion to the exercise resistance.

18. The exercise apparatus of claim 1, further comprising bumpers mounted in the upper and lower ends of the rotatable column and defining upper and lower end stops for the pulley carriage assembly.

19. An exercise apparatus, comprising:

a stationary frame including an upper frame portion and a lower frame portion;

a column which has a longitudinal axis and is hollow along a part of its length to define an internal channel, the column being mounted between the upper and lower frame portions for rotation about the longitudinal axis of the column;

an internal guide track extending along the channel;

a pulley carriage assembly movably engaged with the internal guide track for vertical movement along the internal guide track, the pulley carriage assembly comprising a carriage and a pulley rotationally mounted on the carriage;

an exercise resistance;

a cable assembly coupled with the exercise resistance and including a cable extending around part of the pulley and having a cable end extending out of the column;

a cable pull secured to the cable end extending out of the column, the cable pull being attachable to a selected accessory for engagement by a user when performing an exercise;

an indexing plate mounted inside the column and extending vertically along the longitudinal axis of the column, the indexing plate having a plurality of spaced holes; and a locking device associated with the pulley carriage assembly which is selectably engageable with one of the spaced holes in the indexing plate to secure the pulley carriage assembly at a selected height, wherein the pulley carriage assembly further comprises a cover which is partially outside of the column, wherein the locking device comprises a spring-loaded pin which is linked to the cover and is movable between a locked position engaging one selected hole in the indexing plate and a released position, and wherein the cover is pivotally mounted for movement between first and second positions corresponding to the respective locked and released positions of the spring-loaded pin.

20. The exercise apparatus of claim 19, wherein the cover has a gripping portion for engagement by a user to move the cover between the first and second positions in order to move the spring-loaded pin between the locked and released positions.

21. The apparatus of claim 20, wherein the spring-loaded pin is biased into the locked position when the user releases the gripping portion of the cover.

22. The exercise apparatus of claim 19, further comprising:

an opening in the column that extends along a major portion of the length of the internal channel;

forward facing rims on opposite sides of the opening in the column; and an outer guard strip extending along each rim to protect the rim on release of the cover.

23. An exercise apparatus, comprising:

a stationary frame including an upper frame portion and a lower frame portion;

a column which has a longitudinal axis and is hollow along a part of its length to define an internal channel, the column being mounted between the upper and lower frame portions for rotation about the longitudinal axis of the column;

an internal guide track extending along the channel;

a pulley carriage assembly movably engaged with the internal guide track for vertical movement along the internal guide track, the pulley carriage assembly comprising a carriage and a pulley rotationally mounted on the carriage;

an exercise resistance; a cable assembly coupled with the exercise resistance and including a cable extending around part of the pulley and having a cable end extending out of the column; and a cable pull secured to the cable end extending out of the column, the cable pull being attachable to a selected accessory for engagement by a user when performing an exercise;

a first pivot connection between an upper end of the column and the upper frame portion; and a second pivot connection between a lower end of the column and the lower frame portion, the second pivot connection being substantially aligned with the first pivot connection, wherein the pivot connections are configured for 360-degree rotation of the column about the longitudinal axis of the column.

24. The exercise apparatus of claim 23, wherein each pivot connection comprises a spindle member and a sleeve member rotationally engaged with the spindle member, wherein for each pivot connection, one of the spindle member or sleeve member is associated with the column and the other of the spindle member or sleeve member is associated with the respective upper or lower frame portion, and wherein each pivot connection has an opening through which cables extend into the column.

25. The exercise apparatus of claim 23, further comprising upper and lower covers which conceal portions of the first and second pivot connections, respectively.

26. An exercise apparatus, comprising:

a stationary frame including an upper frame portion and a lower frame portion;

a rotatable column which has a longitudinal axis and is hollow along a part of its length to define an internal channel, the rotatable column being mounted between the upper and lower frame portions for rotation about the longitudinal axis of the rotatable column and having an opening extending along a portion of the length of the internal channel;

an indexing plate mounted inside the rotatable column and extending vertically along the longitudinal axis of the column, the indexing plate having a plurality of spaced holes;

a pulley carriage assembly movably positioned within an internal guide track formed into the rotatable column for movement up and down inside the rotatable column, the pulley carriage assembly comprising a carriage and a pulley rotationally mounted on the carriage;

a locking device associated with the pulley carriage assembly which is selectably engageable with one of the spaced holes in the indexing plate to secure the pulley carriage assembly at a selected height;

an exercise resistance;

a cable assembly coupled with the exercise resistance and including a cable within the rotatable column, the cable extending around part of the pulley and extending out of the opening in the rotatable column; and a cable pull secured to an end of the cable, the cable pull being attachable to a selected accessory for engagement by a user when performing an exercise.

27. An exercise apparatus, comprising:

a stationary frame including opposite first and second side frames, each side frame having an upper frame portion and a lower frame portion;

a first rotatable column which has a longitudinal axis and is hollow along a part of its length to define an internal channel, the first rotatable column being mounted between the upper and lower frame portions of the first side frame for rotation about the longitudinal axis of the first rotatable column;

a second rotatable column which has a longitudinal axis and is hollow along a part of its length to define an internal channel, the second rotatable column being mounted between the upper and lower frame portions of the second side frame for rotation about the longitudinal axis of the second rotatable column;

a first internal guide track formed into and extending along the channel within the first rotatable column;

a second internal guide track formed into and extending along the channel within the second rotatable column;

a first pulley carriage assembly positioned within the first internal guide track for vertical movement along the first internal guide track within the first column, the first pulley carriage assembly comprising a first carriage and a first pulley rotationally mounted on the first carriage;

a second pulley carriage assembly positioned within the second internal guide track for vertical movement along the second internal guide track within the second column, the second pulley carriage assembly comprising a second carriage and a second pulley rotationally mounted on the second carriage;

a first cable assembly associated with an exercise resistance and including a first cable within the first rotatable column, the first cable extending around part of the first pulley and having a first cable end extending out of the first column;

a first cable pull secured to the first cable end extending out of the first column, the first cable pull being attachable to a selected first accessory for engagement by a user when performing an exercise;

a second cable assembly associated with an exercise resistance and including a second cable within the second rotatable column, the second cable extending around part of the second pulley and having a second cable end extending out of the second column; and a second cable pull secured to the second cable end extending out of the second column, the second cable pull being attachable to a selected second accessory for engagement by a user when performing an exercise.

28. The exercise apparatus of claim 27, wherein the first cable assembly is coupled to a first exercise resistance and the second cable assembly is coupled to a second exercise resistance.

29. The exercise apparatus of claim 28, wherein the first exercise resistance includes a first selectorized weight stack and the second exercise resistance includes a second selectorized weight stack.

30. The exercise apparatus of claim 27, wherein the first and second cable assemblies are both coupled to a single selectorized weight stack.

31. The exercise apparatus of claim 27, wherein the stationary frame further comprises a central weight stack housing and the first and second side frames extend from the weight stack housing.

32. The exercise apparatus of claim 27, wherein the first and second side frames are oriented to form a generally V-shaped frame when viewed from above.

* * * * *